United States Patent [19]

Castillo

[11] 4,137,925

[45] Feb. 6, 1979

[54] HAIR CUTTING GUIDE

[76] Inventor: Ralph D. Castillo, 6257 E. 13 St., Wichita, Kans. 67208

[21] Appl. No.: 822,685

[22] Filed: Aug. 8, 1977

[51] Int. Cl.[2] ..... A45D 24/36

[52] U.S. Cl. ..... 132/45 R

[58] Field of Search ..... 132/45 R, 144

[56] References Cited

U.S. PATENT DOCUMENTS

| | | | |
|---|---|---|---|
| 1,329,437 | 2/1920 | Smith | 132/45 R |
| 1,457,257 | 5/1923 | McLaughlin | 132/45 R X |
| 1,544,868 | 7/1925 | Sprengnether | 132/45 R |
| 1,639,804 | 8/1927 | Lewis | 132/45 R |
| 2,542,450 | 2/1951 | Altman | 132/45 R |

*Primary Examiner*—G. E. McNeill

*Attorney, Agent, or Firm*—John H. Widdowson

[57] ABSTRACT

A hair cutting guide to aid a hair stylist in the uniform cutting of hair on a head. The guide providing a pattern for quickly cutting the hair to a particular hair style and using the guide over again for cutting the same hair style at the same length or the guide may be adjusted for cutting a new hair style at a different length.

2 Claims, 6 Drawing Figures

HAIR CUTTING GUIDE

BACKGROUND OF THE INVENTION

This invention relates generally to the cutting and styling of hair, and more particularly, but not by way of limitation, to a hair cutting guide for cutting and styling women's hair.

Heretofore, women's hair stylists, barbers, or the like, have cut hair by memory and experience. Also, hair stylists have created new hair styles through trial and error. While a customer may like her new hair style and length of cut, she has no reassurance that the next time her hair is styled she will have her hair cut the same length, with the exact same style. Also, depending on the accuracy of the hair stylist, the hair is often not cut at a uniform length. By this, the right side of the head may have the hair cut slightly longer or shorter than the left side of the head. Also, bangs along the forehead of the customer and hair along the nape of the neck may not be cut a uniform length.

There are prior art hair holders, hair cutting devices for the cutting of flat top hair styles for men and cutting devices for the bobbing of children's hair. None of these prior art hair cutting devices provide the unique structure of the subject invention, nor do they solve the above described problems in the cutting and styling of hair.

SUMMARY OF THE INVENTION

The subject hair cutting guide provides an aid to a hair stylist for uniformly cutting hair at the same length. The guide also provides a pattern for cutting the same hair style when the customer desires to continue with the same hair style at the same length.

The hair cutting guide is simple in design and may be used for cutting both men and women's hair, but more particularly, for cutting the latest hair styles for women. The guide is adjustable for cutting hair at different lengths. The guide is also adjustable and may be formed for cutting a particular hair style.

The guide may be used for only one customer for repeated use in cutting the same hair style at the same length, or by noting the adjustments required on the hair guide for a particular customer, the guide may be used for any number of customers and then readjusted for that particular customer, so that their hair may be cut with the same style and length.

The hair cutting guide includes an adjustable head band for positioning around the top of the head. Mounted vertically on the left and right side of the head band are vertically adjustable side straps. A rear strap is vertically mounted to the rear of the head band and is adjustable vertically. A flexible hair line strap is attached to the front of the head band and extends downwardly on both sides of the forehead, along the right and left sides of the head where it is attached to the bottom of the side straps. The flexible hair line strap continues around to the rear of the head and is secured to the bottom of the rear strap. By adjusting the flexible hair line strap upwardly and downwardly on the side straps and rear straps, various hair styles such as a blunt cut, wedge cut, or any similar styles may be cut. Also, by adjusting flexible links which make up the hair line strap, bangs, a flair, or any other similar forehead cut, may be made in the front of the head.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
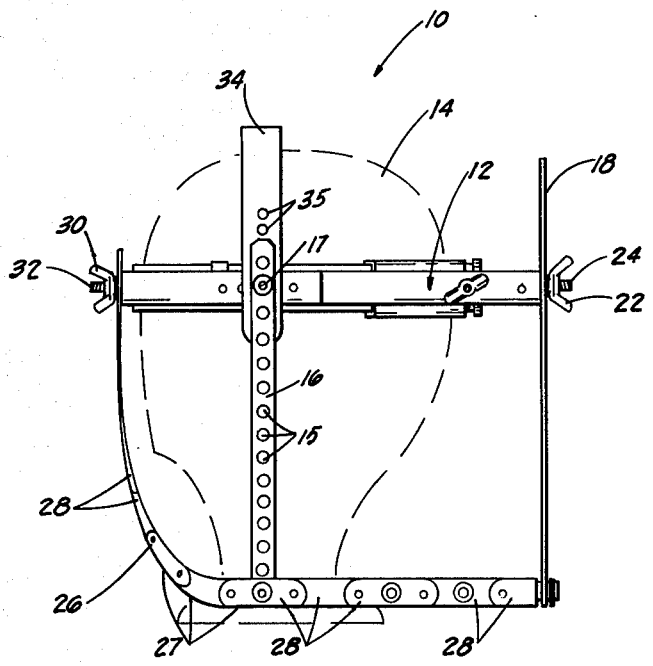
In FIG. 1, a side view of the hair cutting guide is illustrated mounted on top of a human head outlined in dotted lines.

In FIG. 1, the hair cutting guide is designated by general reference numeral 10. The guide 10 includes an adjustable head band 12 which is disposed around the top of a human head designated by numeral 14 and shown in dotted lines. A pair of vertically mounted side straps 16 are mounted on both the right and left side of the head band 12. Both of the side straps 16 can be seen in FIG. 3. The side straps 16 include a plurality of apertures 15 along the length of the strap 16 so that the height of the side straps 16 can be adjusted vertically and secured on the head band 12 by threaded screws 17. The guide 10 also includes a rear strap 18 having a plurality of apertures 20 and shown more clearly in FIG. 4. The rear strap 18 is also adjusted vertically by removing a threaded nut 22 and indexing one of the apertures 20 around a screw 24.

A hair line strap 26 comprised of a plurality of flexible links 28 is attached to the front of the head band 12 by a threaded nut 30 and screw 32. The hair line strap 26 extends downwardly from both sides of the forehead along the left and right side of the head 14 and around the rear of the head 14. The hair line strap 26 is attached to the bottom of the side straps 16 and the rear strap 18. A bottom edge 27 of the strap 26 provides a guide for scissors or a similar tool for cutting the hair.

The guide 10 further includes a top strap 34 attached at both ends to the side of the head band 12 and extending over the top of the head 14. The top strap 34 includes apertures 35 for adjusting the length of the strap 34 on the head band 12 and provides means for preventing the guide 10 from slipping downwardly around the head should the head band 12 be so large that it does not retain the guide 10 against the sides of the head 14.

Figure 2:
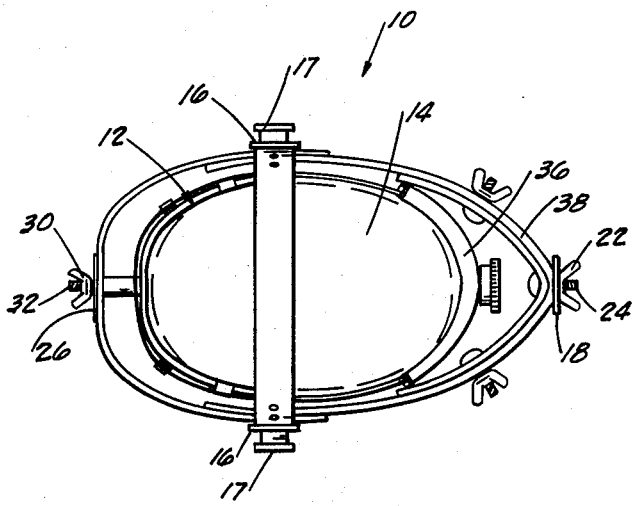
FIG. 2 is a top view of the guide.

In FIG. 2, a top view of the guide 10 is illustrated. In this view, the top strap 34 can be seen extended above the top of the head 14. Also, shown in this view is the head band 12 including an inner band 36 with an outer band 38 attached to the sides of the inner band 36. The outer band 38 is disposed around the inner band 36 in a spaced relationship for positioning the side straps 16, rear strap 18, and hair line strap 26 outwardly and away from the sides of the head 14 so that the straps will be adjacent the hair as it is combed downwardly from the top and sides of the head. While the inner band 36 and outer band 38 are shown, it should be appreciated that a single head band could work equarlly as well for holding the straps 16, 18 and 26 outwardly fromthe head 14.

Figure 3:
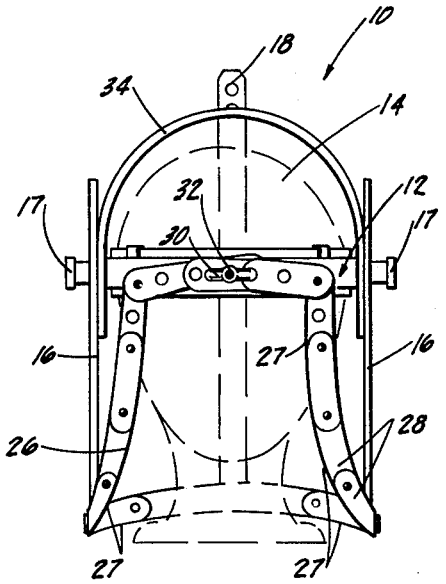
FIG. 3 is a front view of the guide adjusted for cutting bangs.

In FIG. 3, a front view of the guide 10 is shown with the adjustable hair line strap 26 adjusted for cutting a hair style having bangs along the forehead. It should be noted by moving the individual flexible links 28, which are rotatably attached at both ends to adjacent links 28, various hair styles may be formed along the length of the hair line strap 26. In this illustration, it should be noted that the side straps 16 are adjusted an equal distance downwardly from the head band 12 for cutting the hair the same length along the sides which in this case would be approximately shoulder length. Also, shown in dotted lines is the flexible hair line strap 26 extending around the nape of the neck.

Figure 4:
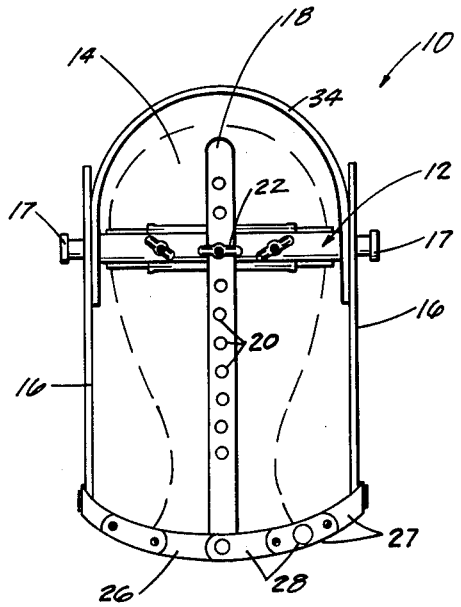
FIG. 4 is a rear view of the guide adjusted for a wedge cut along the back of the neck.
Figure 5:
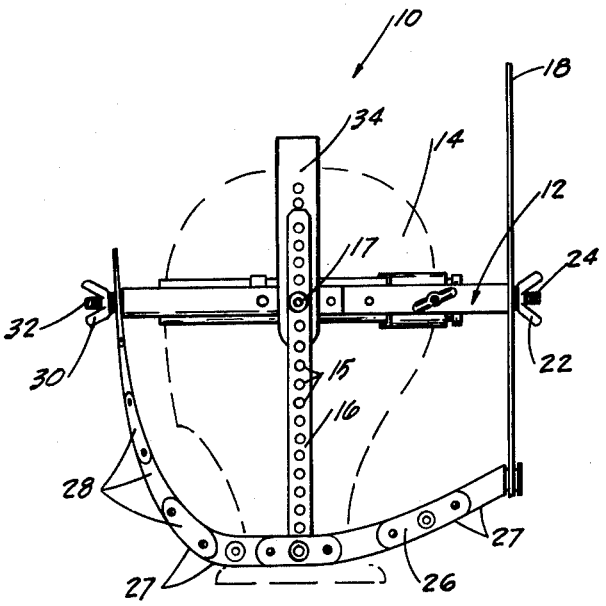
FIG. 5 is a side view of the guide adjusted for an alternate hair style.

In FIG. 4, a rear view of the guide 10 is illustrated for cutting a wedge cut hair style. By indexing the correct aperture 20 in the rear strap 18, the rear strap 18 is lowered to a position below the side straps 16, thereby forming a semi-circular cutting line along the rear of the shoulder. In FIG. 5, a side view of the guide 10 is shown adjusted for forming a pattern for an alternate hair style wherein it is desired to cut the hair at the rear of the head at a shorter length than the sides of the head. In this example, the rear strap 18 is raised on the head band 12 with the appropriate aperture 20 received around the threaded screw 24.

Figure 6:
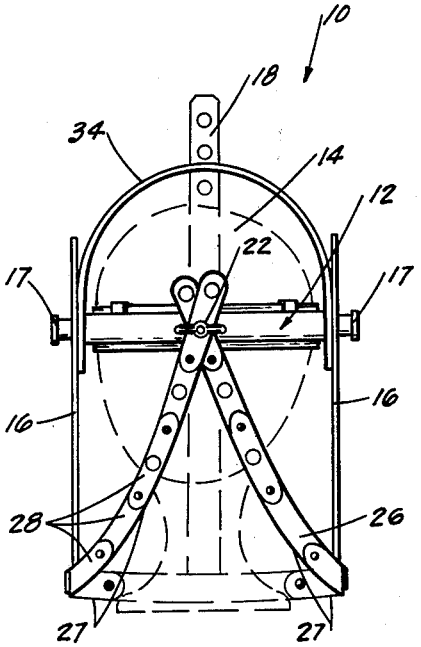
FIG. 6 is a front view of the guide adjusted for cutting a flair style in the forehead.

In FIG. 6, a front view of the guide 10 is illustrated with the hair line strap 26 adjusted for cutting a flair hair style along both sides of the forehead. The hair line strap 26 extends downwardly along the left and right side of the head 14 with the hair line strap 26 attached to the bottom of the rear strap 18 at the same length as the adjusted length on the side straps 16.

In operation, the hair cutting guide 10 is placed on the head 14 with the head band 12 adjusted so that it fits comfortably on top of the head. Depending on the hair style desired and the length of hair required, the side straps 16 and rear strap 18 are adjusted accordingly. As mentioned above, this is done by removing the appropriate threaded nuts and the apertures in the straps adjusted accordingly on screw extended outwardly from the head band 12. When the length of the straps 16 and 18 are adjusted accordingly, the bottom of the hair line strap 26 acts as a guide along the sides of the head for cutting the hair a uniform length so that the hair is cut at an equal length on both right and left side and at the rear of the head. Also, because the hair line strap 26 is constructed of flexible links, the hair line strap 26 may be adjusted in the front of the head 14 for cutting bangs, a flair, or any similar type of hair style on the forehead.

Changes may be made in the construction and arrangement of the parts or elements of the embodiment as disclosed herein without departing from the spirit or scope of the invention as defined in the following claims.

I claim:

1. A hair cutting guide for assisting a hair stylist in cutting various hair styles on a head and at a uniform length, the guide comprising:

(a) a head band received around the top of the head;

(b) a rear strap vertically mounted on the rear of said head band and vertically adjustable on said head band;

(c) a pair of side straps vertically mounted on opposite sides of said head band and vertically adjustable on said head band;

(d) a hair line strap attached to the front of said head band and extending downwardly and along the opposite sides of the head, said hair line strap attached to the bottom of said rear strap; and (e) a top strap, said top strap extending over the top of the head with the ends of said top strap adjustable attached to the sides of said head band;

said rear strap and said side straps include a plurality of apertures along the length thereof, said apertures received in a threaded bolt in the sides and rear of said head band for adjusting the vertical height of said side straps and said rear strap;

said hair line strap is made of a plurality of flexible links, by adjusting said flexible links various configurations can be formed in providing a desired hair style;

said head band includes an inner band received around the top of the head and an outer band attached to the inner band and extending outwardly therefrom for suspending said side straps and said rear strap.

2. The guide as described in claim 1 wherein said hair line strap attaches to the front of said outer head band and extends downwardly along both sides of the head, said hair line strap attaches to the bottom of said side straps and extends around the rear of the head and attaches to the bottom of said rear strap.

* * * * *

UNITED STATES PATENT AND TRADEMARK OFFICE

CERTIFICATE OF CORRECTION

PATENT NO. : 4,137,925

DATED : February 6, 1979

INVENTOR(S) : Ralph D. Castillo

It is certified that error appears in the above-identified patent and that said Letters Patent are hereby corrected as shown below:

Column 2, line 67 delete "fromthe" and insert therefor ---from the---.

Column 3, line 40 delete "screw" and insert therefor ---screws---.

Column 3, line 44 before "for" insert ---and the rear of the head---.

Column 4, line 22 delete "rear strap; and" and insert therefor ---side straps and extending around the rear of the head and attached to the bottom of said rear strap; and---.

Column 4, line 24 delete "adjustable" and insert therefor ---adjustably---.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*